US010865569B1

(12) United States Patent
Bilge

(10) Patent No.: US 10,865,569 B1
(45) Date of Patent: Dec. 15, 2020

(54) INTERLOCKING WALL PANELS FOR SECUREMENT TO A WALL

(71) Applicant: Henry H. Bilge, Fort Lee, NJ (US)

(72) Inventor: Henry H. Bilge, Fort Lee, NJ (US)

( * ) Notice: Subject to any disclaimer, the term of this patent is extended or adjusted under 35 U.S.C. 154(b) by 0 days.

(21) Appl. No.: 16/415,672

(22) Filed: May 17, 2019

(51) Int. Cl.

| | |
|---|---|
| ***E04F 13/08*** | (2006.01) |
| ***E04F 13/072*** | (2006.01) |
| ***E04F 19/06*** | (2006.01) |
| ***E04B 2/18*** | (2006.01) |
| *E04B 2/02* | (2006.01) |

(52) U.S. Cl.
CPC ..... *E04F 13/083* (2013.01); *E04B 2/18* (2013.01); *E04F 13/072* (2013.01); *E04F 13/0891* (2013.01); *E04F 19/064* (2013.01); *E04B 2002/025* (2013.01)

(58) Field of Classification Search
CPC ..... E04B 2/18; E04B 2002/025; E04B 2/88; E04B 2/96; E04B 2/885; E04B 2/90; E04F 13/083; E04F 13/072; E04F 13/0891; E04F 19/064; E04F 13/26; E04F 13/24; E04F 13/076
USPC ..... 52/235
See application file for complete search history.

(56) References Cited

U.S. PATENT DOCUMENTS 4,189,885 A * 2/1980 Fritz ..... E04F 13/0842 52/278
4,553,363 A * 11/1985 Weinar ..... E04F 19/064 52/288.1
8,127,507 B1 * 3/2012 Bilge ..... E04F 13/0823 52/235
9,091,079 B2 * 7/2015 Wright ..... E04F 13/0816
9,874,026 B2 * 1/2018 Bilge ..... E04F 13/0891
10,316,525 B1 * 6/2019 Bilge ..... E04F 13/076
2007/0022682 A1 * 2/2007 Morgenegg ..... E04B 2/90 52/235
2008/0168723 A1 * 7/2008 Bilge ..... E04F 13/0814 52/235
2009/0241451 A1 * 10/2009 Griffiths ..... E04F 13/081 52/309.4
2012/0304573 A1 * 12/2012 Aboukhalil ..... E04F 13/0816 52/506.05
2013/0118107 A1 * 5/2013 Maday ..... E04B 2/00 52/506.05
2016/0102462 A1 * 4/2016 Griffiths ..... E04F 13/083 52/550
2018/0058075 A1 * 3/2018 Stoll ..... E04F 13/083

* cited by examiner

*Primary Examiner* — Beth A Stephan
(74) *Attorney, Agent, or Firm* — Joshua Kaplan, Esq.; Kaplan Law Practice, LLC

(57) ABSTRACT

An interlocking wall panel arrangement for mounting wall panels to an existing wall, includes a plurality of wall panels, each wall panel including a main wall panel section, a first interlocking section extend rearwardly from the main wall panel section at one end thereof, the first interlocking section includes walls defining a channel, and a second interlocking section extend rearwardly from the main wall panel section at an opposite end thereof for engaging with a first interlocking section of another the wall panel, the second interlocking section includes a projection wall that fits within the channel of another wall panel; and a securing arrangement for securing the first interlocking section to the existing wall.

18 Claims, 13 Drawing Sheets

INTERLOCKING WALL PANELS FOR SECUREMENT TO A WALL

BACKGROUND OF THE INVENTION

The present invention relates generally to a wall system, and more particularly, to a system for easily mounting wall panels over an existing wall.

In order to enhance the look of a wall structure, it is known to secure decorative wall panels to the wall structure. However, the securement of wall panels to the wall structure is generally a long and tedious job since it entails the use of additional fastening devices to secure each wall panel to the wall structure. Examples of such arrangements are shown in applicant's earlier U.S. Pat. Nos. 8,966,849; 9,359,770; 9,562,361; 9,631,372; 9,765,528; 10,011,997; 10,253,505; and 10,260,240.

It would therefore be desirable to provide wall panels that can be secured directly or indirectly to an existing wall, in which the wall panels are easily interlocked with and/or supported by each other to greatly simplify the assembly thereof.

SUMMARY OF THE INVENTION

Accordingly, it is an object of the present invention to provide wall panels for securement to a wall that overcomes the aforementioned problems.

It is another object of the present invention to provide wall panels for securement to a wall in which the wall panels are easily interlocked with and/or supported by each other to greatly simplify the assembly thereof.

In accordance with an aspect of the present invention, an interlocking wall panel arrangement for mounting wall panels to an existing wall, includes a plurality of wall panels, each wall panel including a main wall panel section, a first interlocking section at one end of the main wall panel section, and a second interlocking section at an opposite end of the main wall panel section for engaging with a first interlocking section of another the wall panel; and a securing arrangement for securing the first interlocking section to the existing wall.

The first interlocking section includes walls defining a channel, and the second interlocking section includes a projection wall that fits within the channel of another wall panel.

The first and second interlocking sections extend rearwardly from the main wall panel section so as to space the main wall panel section from the existing wall when the respective wall panel is secured to the existing wall.

Each wall panel further includes an intermediary support wall extending rearwardly of the main wall panel section at a position between the first and second interlocking sections.

In addition, it is possible that the main wall panel section has a three-dimensional shape in cross-section.

In one embodiment, the securing arrangement includes a tail wall formed integrally as a single piece with the first interlocking section. In such case, the first interlocking section includes walls defining a channel, the second interlocking section includes a projection wall that fits within the channel of the another wall panel, and the tail wall is formed as an extension of the walls defining the channel.

In another embodiment, the securing arrangement includes clips for holding the first interlocking section and which are adapted to be secured to the existing wall by fastening members.

Each clip includes walls defining a channel, and the first interlocking section includes a projection wall that fits within the channel of each respective clip.

The interlocking wall panel arrangement further includes a starter member for securing the second interlocking section of a first wall panel to the existing wall. The starter member includes a base wall adapted to be secured to the existing wall by fastening members, and an L-shaped wall extending outwardly from a free end of the base wall so as to define a channel with the base wall for receiving and holding the second interlocking section therein.

The interlocking wall panel arrangement further includes a finishing member for securing the first interlocking section of a last wall panel to the existing wall. The finishing member includes a base wall adapted to be secured to the existing wall by fastening members, and an L-shaped wall extending outwardly from a free end of the base wall so as to define a channel with the base wall for receiving and holding the first interlocking section therein.

The interlocking wall panel arrangement further includes a side connecting arrangement for connecting together side edges of adjacent wall panels. The side connecting arrangement includes a connecting base having an elongated base wall adapted to be secured to the existing wall along the side edges of the wall panels, a cover wall adapted to be positioned over adjacent side edges of adjacent wall panels and a securing arrangement for securing the cover wall to the connecting base in order to sandwich the side edges of the wall panels therebetween. The securing arrangement includes at least one first wall formed with the cover wall and extending between adjacent side edges of the adjacent side panels, and at least one second wall formed with the connecting base for engaging with and holding the at least one first wall to secure the cover wall in overlying spaced relation with the connecting base.

The interlocking wall panel arrangement further includes a corner connecting arrangement for connecting together ends of adjacent wall panels at either an outside corner of the existing wall, or an inside corner of existing wall.

A spacing exists between adjacent wall panels, and the spacing is adapted to be adjusted by varying dimensions of walls of the first interlocking section and/or the second interlocking section.

The above and other features of the invention will become readily apparent from the following detailed description thereof which is to be read in connection with the accompanying drawings.

DETAILED DESCRIPTION

Figure 1:
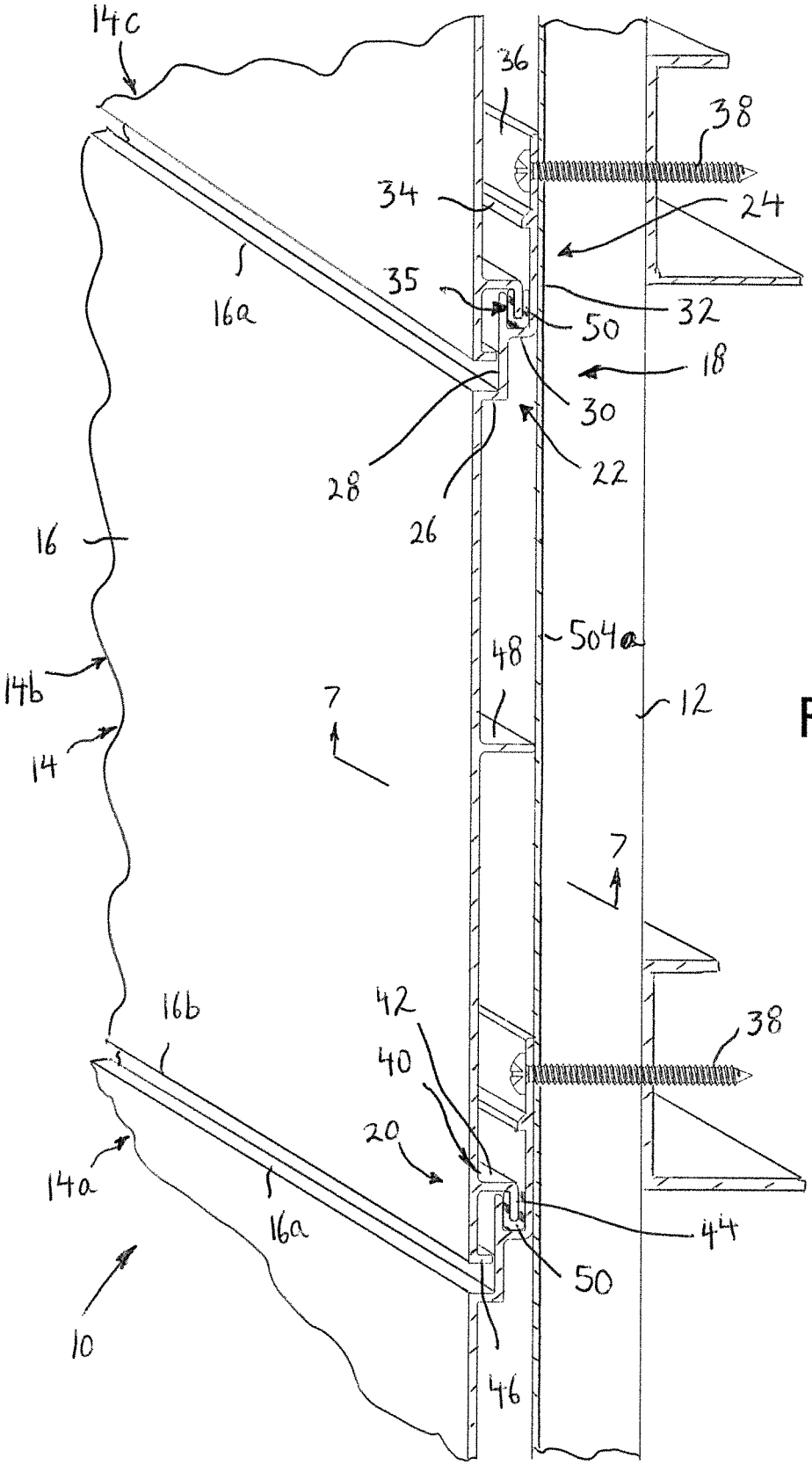
FIG. 1 is a perspective view of an interlocking wall panel arrangement according to a first embodiment of the present invention for easily mounting wall panels over an existing wall.

Referring to the drawings in detail, and initially to FIG. 1 thereof, there is shown an interlocking wall panel arrangement 10 according to a first embodiment of the present invention, for easy mounting over an existing wall 12.

Interlocking wall panel arrangement 10 includes a plurality of wall panels 14. Each wall panel 14 includes a main wall panel section 16, a first interlocking section 18 at a first end 16*a* of main wall panel section 16 and a second interlocking section 20 at the opposite second end 16*b* of main wall panel section 16.

First interlocking section 18 includes a first L-shaped wall 22 connected to the first end 16*a* of main wall panel section 16 and a second L-shaped wall 24 connected to first L-shaped wall 22.

Specifically, first L-shaped wall 22 includes a first wall 26 extending at an angle, preferably a right angle, from the first end 16*a*, rearwardly of main wall panel section 16, and a second wall 28 extending at an angle, preferably a right angle, from the opposite free end of first wall 26, in a direction away from main wall panel section 16 and preferably, in parallel, offset relation from main wall panel section 16.

Second L-shaped wall 24 includes a third wall 30 extending at an angle, preferably a right angle, rearwardly from second wall 28, in a direction away from main wall panel section 16, at a position spaced inwardly from the free end of second wall 28 and preferably in parallel offset relation from first wall 26, and a fourth wall 32 extending at an angle, preferably a right angle, from the opposite free end of first wall 30, in a direction away from main wall panel section 16 and preferably, in parallel, offset relation from both second wall 28 and main wall panel section 16.

It will be appreciated that the free portion of second wall 28, third wall 30 and the connected portion of fourth wall 32 together form a U-shaped channel 35 therebetween.

A lip 34 extends transversely across fourth wall 32 so as to define a tail section 36 between lip 34 and the free end of fourth wall 32.

Fourth wall 32 seats flush against the outer surface of existing wall 12 and spaced apart screws 38 secure tail section 36 to existing wall 12. With this arrangement, main wall panel section 16 extends in parallel, spaced apart relation from the outer surface of existing wall 12.

Second interlocking section 20 includes a third L-shaped wall 40 extending from the rear surface of main wall panel section 16 spaced slightly inwardly from second end 16*b*.

Specifically, third L-shaped wall 40 includes a fifth wall 42 extending at an angle, preferably a right angle, from the rear surface of main wall panel section 16 at a position spaced slightly inwardly from second end 16*b*, and a sixth wall 44 extending at an angle, preferably a right angle, from the opposite free end of fifth wall 42, in a direction away from first L-shaped wall 22 and preferably, in parallel, offset relation from main wall panel section 16.

Further, a lip 46 extends rearwardly at an angle, preferably a right angle, from the second free end 16*b* of main wall panel section 16.

Lastly, to provide additional support, an intermediary support wall 48 extends rearwardly from main wall panel section 16 at a position substantially midway between first interlocking section 18 and second interlocking section 20, with the free end of intermediary support wall 48 preferably seating flush against existing wall 12.

With this arrangement, a first wall panel 14*a* is positioned against exterior wall 12 and secured thereto by spaced apart screws 38 extending through tail section 36. Then, a U-shaped rubber seal 50 is positioned within U-shaped channel 35. Thereafter, a second wall panel 14*b* is assembled in interlocking relation with first wall panel 14*a*. Specifically, sixth wall 44 of second wall panel 14*b* is positioned within rubber seal 50 within U-shaped channel 35 of first wall panel 14*a*. In such position, the free end of lip 46 seats on the outer exposed surface of second wall 28 of first wall panel 14*a*, and the rear surface of fourth wall 32 of second wall panel 14*b* seats flush against existing wall 12 at a higher position. Then, tail section 36 of second wall panel 14*b* is secured to existing wall 12 by spaced apart screws 38. It will be appreciated that, during this procedure, second wall panel 14*b* is supported at its lower end in interlocking relation on first wall panel 14*a*. Thereafter, a third wall panel 14*c* is secured with second wall panel 14*b* in the same manner, and so on.

As will be described in other embodiments hereafter, a starter member is preferably provided at the lower end of the first wall panel 14*a* for supporting the same on existing wall 12, and a finishing member is preferably provided at the upper end of the uppermost wall 14*c* for covering and supporting the upper end thereof.

With the above arrangement, assembly of the wall panels 14 on existing wall 12 is greatly simplified, with the lower end of each wall panel 14 being supported during assembly, and the wall panels 14 interlocking with each other.

Figure 2:
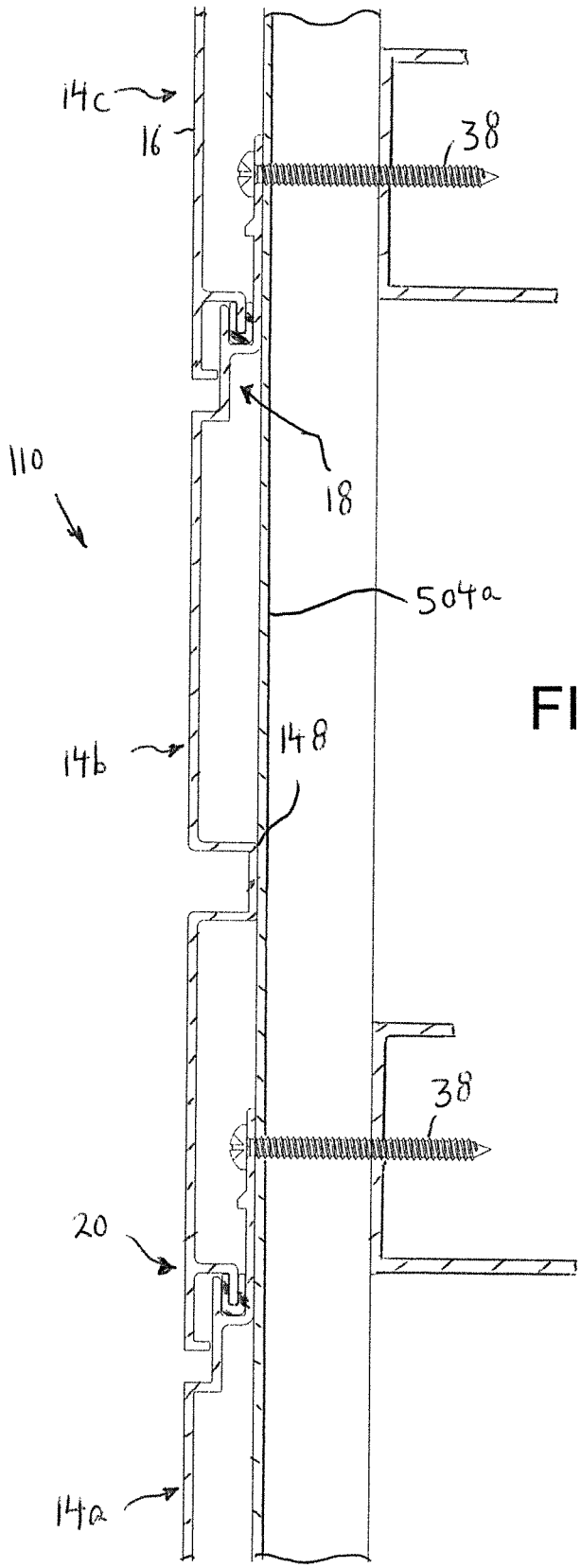
FIG. 2 is a cross-sectional view of an interlocking wall panel arrangement according to a modification of the first embodiment.

FIG. 2 shows a wall panel arrangement 110 which is identical with wall panel arrangement 10 of FIG. 1, except as discussed below. Elements common to both wall panel arrangements 10 and 110 are described by the same numerals.

Wall panel arrangement 110 differs from wall panel arrangement 10 by the replacement of the single intermediary support wall 48 with a U-shaped intermediary support wall 148.

Figure 3:
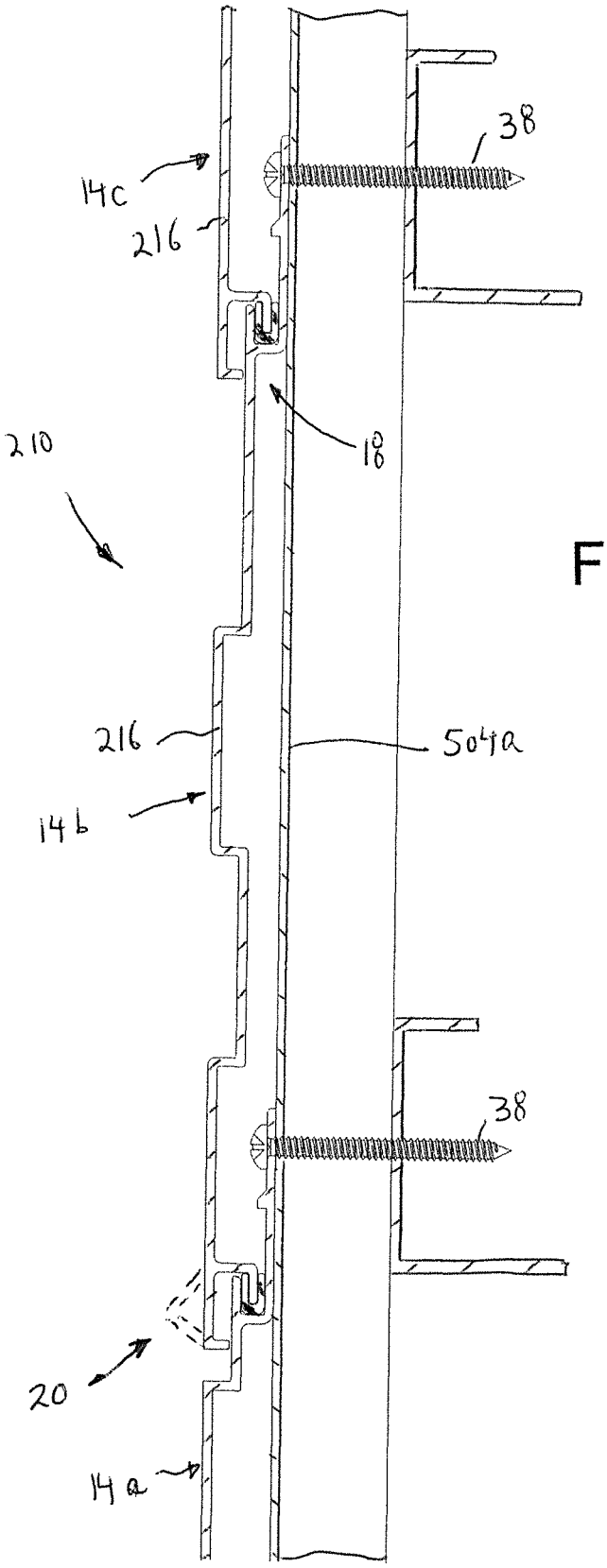
FIG. 3 is a cross-sectional view of an interlocking wall panel arrangement according to another modification of the first embodiment.

FIG. 3 shows a wall panel arrangement 210 which is identical with wall panel arrangement 10 of FIG. 1, except as discussed below. Elements common to both wall panel arrangements 10 and 210 are described by the same numerals.

Wall panel arrangement 210 differs from wall panel arrangement 10 by the elimination of the single intermediary support wall 48. In addition, main wall panel section 216 is not planar, but rather, has a three-dimensional shape. In wall panel arrangement 210, main wall panel section 216 has a square wave shape in cross-section. This provides additional rigidity to main wall panel section 216, while also presenting a three-dimensional appearance.

It will be appreciated, however, that any three-dimensional shape can be used for the main wall panel section, for example, three-dimensional shapes of the type shown in applicant's U.S. Pat. No. 9,631,372.

Figure 4:
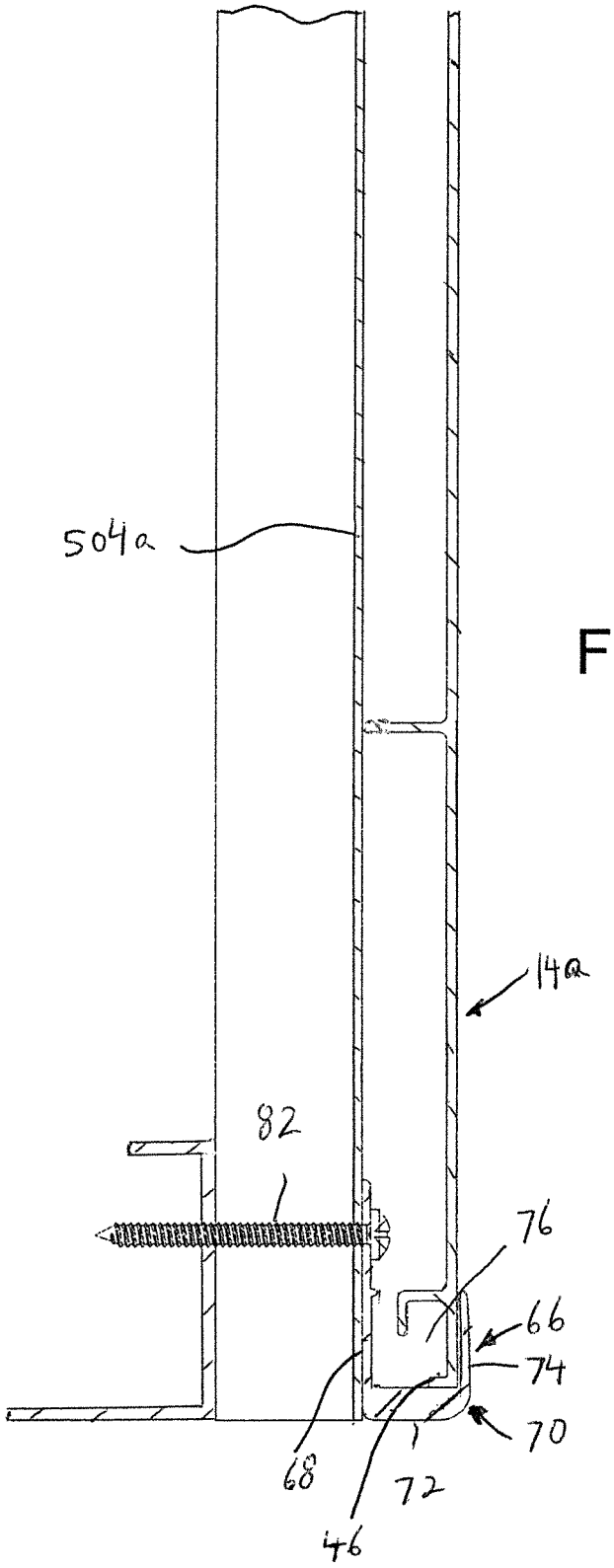
FIG. 4 is a cross-sectional view showing securement of a lowermost end of the interlocking wall panel arrangement according to the first embodiment.

As shown in FIG. 4, in order to start the assembly process, a starter member 66 is secured to the lower and of existing wall 12. Starter member 66 includes an elongated base wall 68 which is secured to existing wall 12 by screws 82. An L-shaped wall 70 extends outwardly from the free lower end of elongated base wall 68. Specifically, L-shaped wall 70 includes a first wall 72 that extends outwardly at an angle, preferably a right angle, from the lower free end of elongated base wall 68, and a second wall 74 extending upwardly from the free end of first wall 72 in overyling, parallel spaced relation to elongated base wall 68, but being of a much lesser length. As a result, a U-shaped channel 76 is defined between base wall 68, first wall 72 and second wall 74.

With this arrangement, as shown in FIG. 4, lip 46 of a lowermost wall panel 14*a* rests on first wall 72 and is supported thereby. Then, screws 38 secure tail section 36 of this same wall panel 14*a* to existing wall 12 in the manner shown in FIG. 1. Thereafter, a second wall panel 14*b* is assembled in interlocking relation with first wall panel 14*a* in the manner described above with respect to FIG. 1. The assembly then continues in the same manner described above with respect to FIG. 1.

At the upper end of the last, uppermost wall panel 14*u*, a finishing member is provided which can be identical to starter member 66 but turned 180 degrees, in order to hold the upper end of the uppermost wall panel 14*u* to existing wall 12.

Figure 5:
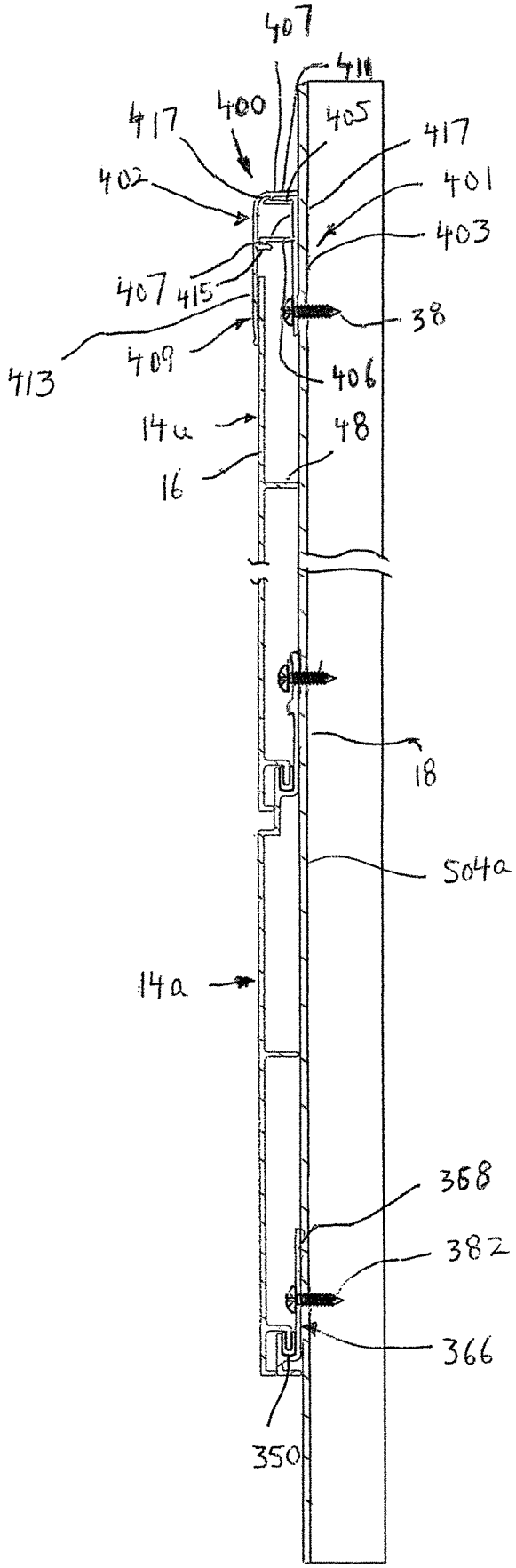
FIG. 5 is a cross-sectional view showing securement of the lowermost end and uppermost end of the interlocking wall panel arrangement according to the first embodiment.
Figure 6:
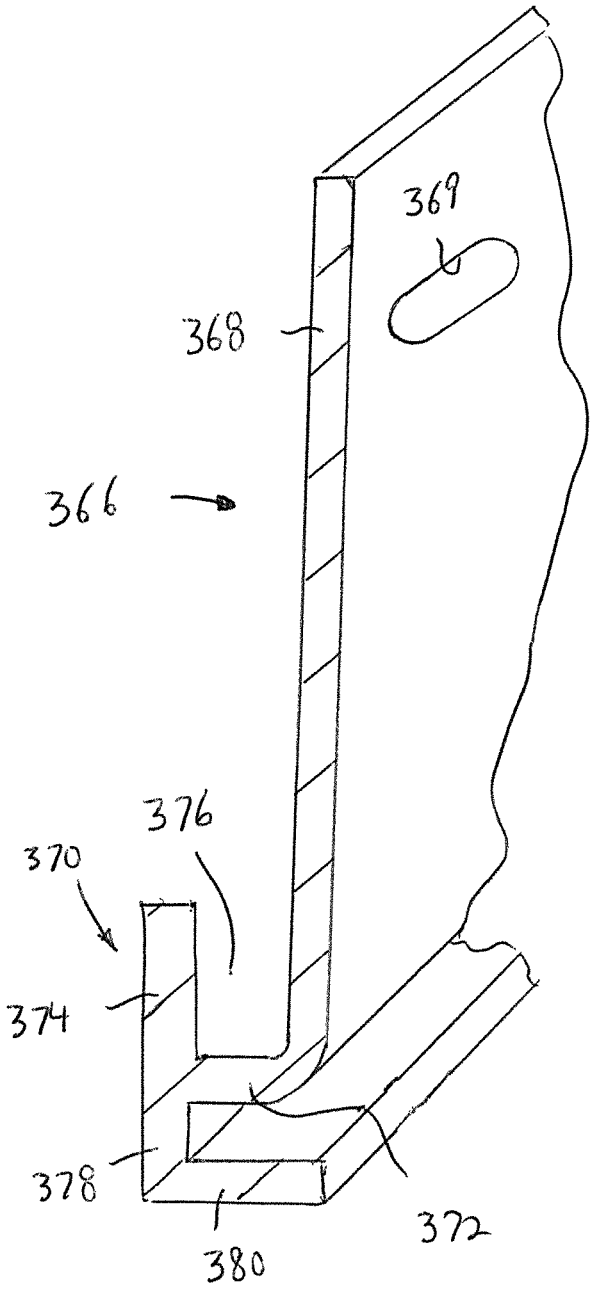
FIG. 6 is an enlarged perspective view, partly in section, of the starter member of FIG. 5.

A different arrangement for a starter member and finishing member is shown in FIGS. 5 and 6. In order to start the assembly process, a starter member 366 is secured to the lower end of existing wall 12. As shown best in FIG. 6, starter member 366 includes an elongated base wall 368 which is secured to existing wall 12 by screws 382. A first L-shaped wall 370 extends outwardly from the free lower end of elongated base wall 368. Specifically, L-shape wall 370 includes a first wall 372 that extends outwardly at an angle, preferably a right angle, from the lower free end of elongated base wall 368, and second wall 374 extending upwardly from free end of first wall 372 in overlying, parallel spaced relation to elongated base wall 368, but being of a much lesser length. As a result, a U-shaped channel 376 is defined between base wall 368, first wall 372 and second wall 374.

A further wall 378 extends downwardly in a coplanar manner from second wall 374, and a closure wall 380 extends inwardly from the lower end of further wall 378.

With this arrangement, as shown in FIG. 5, the free end of elongated base wall 368 is positioned flush against existing wall 12 and secured thereto by screws 382 extending through elongated base wall 368 into existing wall 12, to secure starter member 366 thereat. Then, a U-shaped rubber seal 350 is positioned within U-shaped channel 376. Thereafter, a first wall panel 14*a* is assembled in interlocking relation with starter member 366. Specifically, sixth wall 44 is positioned within U-shaped rubber seal 350 within U-shaped channel 376. In such position, the free end of lip 46 seats on the outer exposed surface of further wall 378 in coplanar arrangement with closure wall 380. Further, base wall 368 can include an elongated opening 369 to provide adjustability.

The assembly continues in the same manner as previously described. At the upper end of the last, uppermost wall panel 14*u*, a finishing member 400 is provided. As shown in FIG. 5, uppermost wall panel 14*u* does not include a first interlocking section 18, although it could include a first interlocking section 18.

Finishing member 400 includes a finishing member base 401 and a finishing member cover 402. Finishing member base 401 includes a base wall 403 secured to existing wall 12 by screws 38 at the lower end thereof, and two parallel, spaced apart walls 405 and 406 extending outwardly from the upper end of base wall 403, one above the other. A barb 407 is formed at the free end on the outer facing surface of each wall 405 and 406.

Finishing member cover 402 includes an L-shaped wall 409. Specifically, L-shaped wall 409 includes a first wall 411 in parallel covering relation to uppermost wall 405, and a second wall 413 connected at an angle, preferably a right angle, to the outer free end of first wall 411 so as to be in parallel, spaced apart relation to base wall 403. In this manner, second wall 413 is in covering relation to base wall 403 and lies flush over the free end of main wall panel section 16 of uppermost wall panel 14*u*, so as to retain uppermost wall panel 14*u* in position.

A short stub wall 415 extends inwardly from the inner surface of second wall 413 so as to be positioned to the outside of wall 406 when first wall 411 is positioned to the outside of uppermost wall 405. Both first wall 411 and stub wall 415 include barbs 417 which snap onto and engage barbs 407 in order to retain finishing wall cover 402 on finishing wall securement 401.

Figure 7:
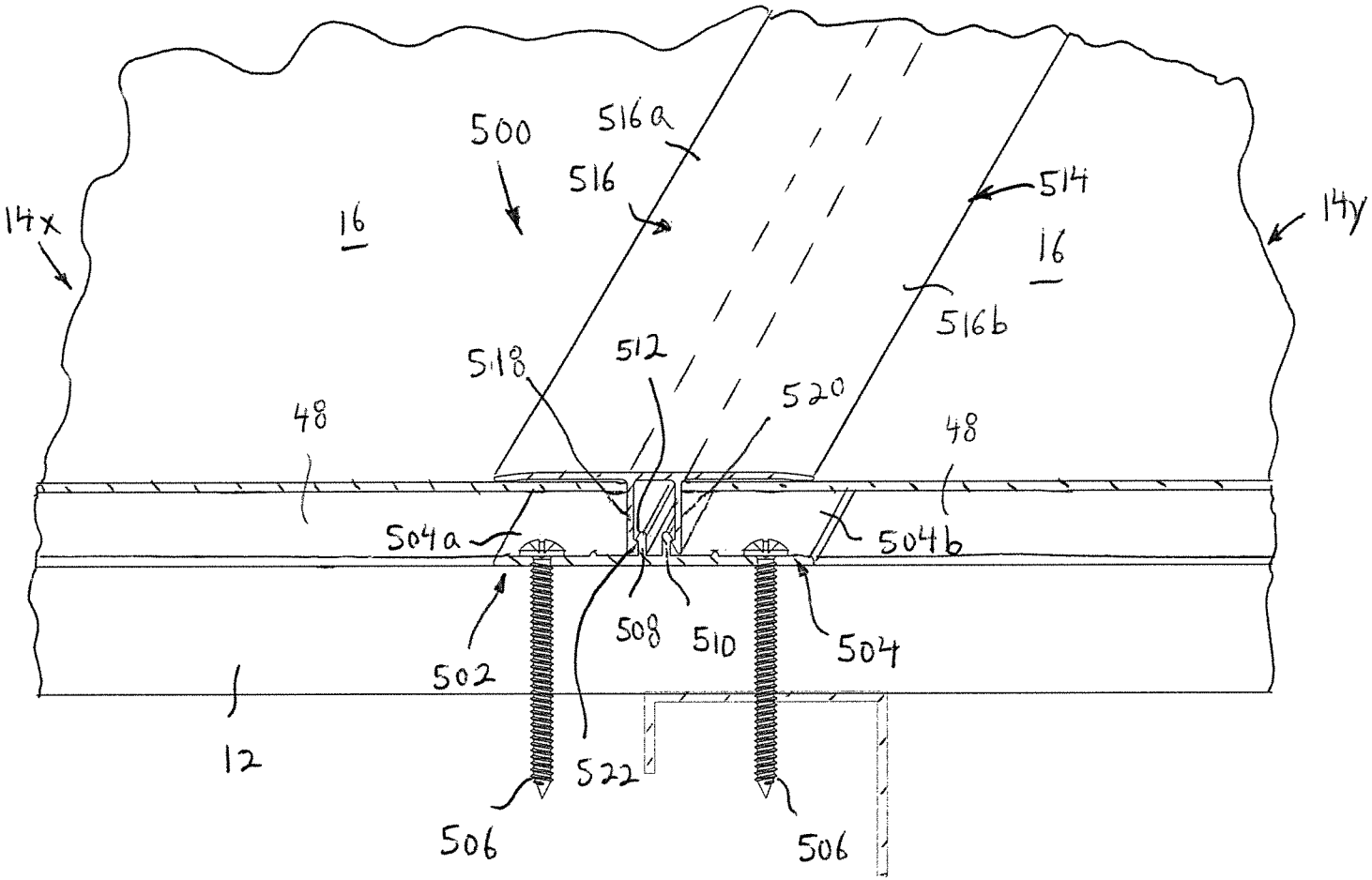
FIG. 7 is a perspective view, partly in cross-section, of a side connecting arrangement for connecting together wall panels with the first embodiment.

Referring now to FIG. 7, there is shown a side connecting arrangement 500 for connecting together side edges of adjacent wall panels 14*x* and 14*y*.

Specifically, side connecting arrangement 500 includes a connecting base 502 having an elongated base wall 504 secured to existing wall 12 along the entire side edges of wall panels 14*x* and 14*y* by screws 506. Two parallel, spaced apart stub walls 508 and 510 extend outwardly from base wall 504 at the center thereof, and extend along the length of base wall 504. Each stub wall 508 and 510 includes an outwardly extending barb 512 at the upper end thereof. Stub walls 508 and 510 thereby define a left base wall section 504*a* and a right base wall section 504*b*.

Side connecting arrangement 500 further includes a cover 514 formed by an elongated upper cover wall 516 of the same width as elongated base wall 504. Two parallel, spaced apart securing walls 518 and 520 extend outwardly from cover wall 516 at the center thereof, and extend along the length of cover wall 516. The spacing between walls 518 and 520 is slightly greater than the spacing between walls 508 and 510 to permit walls 508 and 510 to extend between walls 518 and 520. Each wall 518 and 520 includes an inwardly extending barb 522 at the lower end thereof for engagement with barbs 512 in order to secure cover 514 to base 502. Walls 518 and 520 thereby define a left cover wall section 516*a* and a right cover wall section 516*b*.

With this arrangement, base wall 504 is secured to existing wall 12 by screws 506 along the entire side edges of two adjacent wall panels 14*x* and 14*y*. In this regard, left base wall section 504*a* is sandwiched between existing wall 12 and first interlocking section 18, second interlocking section 20 and intermediary support wall 48 of wall panel 14*x*, as shown in FIG. 1. In like manner, right base wall section 504*b* is sandwiched between existing wall 12 and first interlocking section 18, second interlocking section 20 and intermediary support wall 48 of wall panel 14*y*. As such, the side edge of main wall panel section 16 of wall panel 14*x* is butted against wall 518, while the adjacent side edge of main wall panel section 16 of wall panel 14*y* is butted against wall 520. Thus, cover wall 516 covers the gap between the side edges of wall panels 14*x* and 14*y*, while also helping to secure wall panels 14 in position on existing wall 12.

Figure 8:
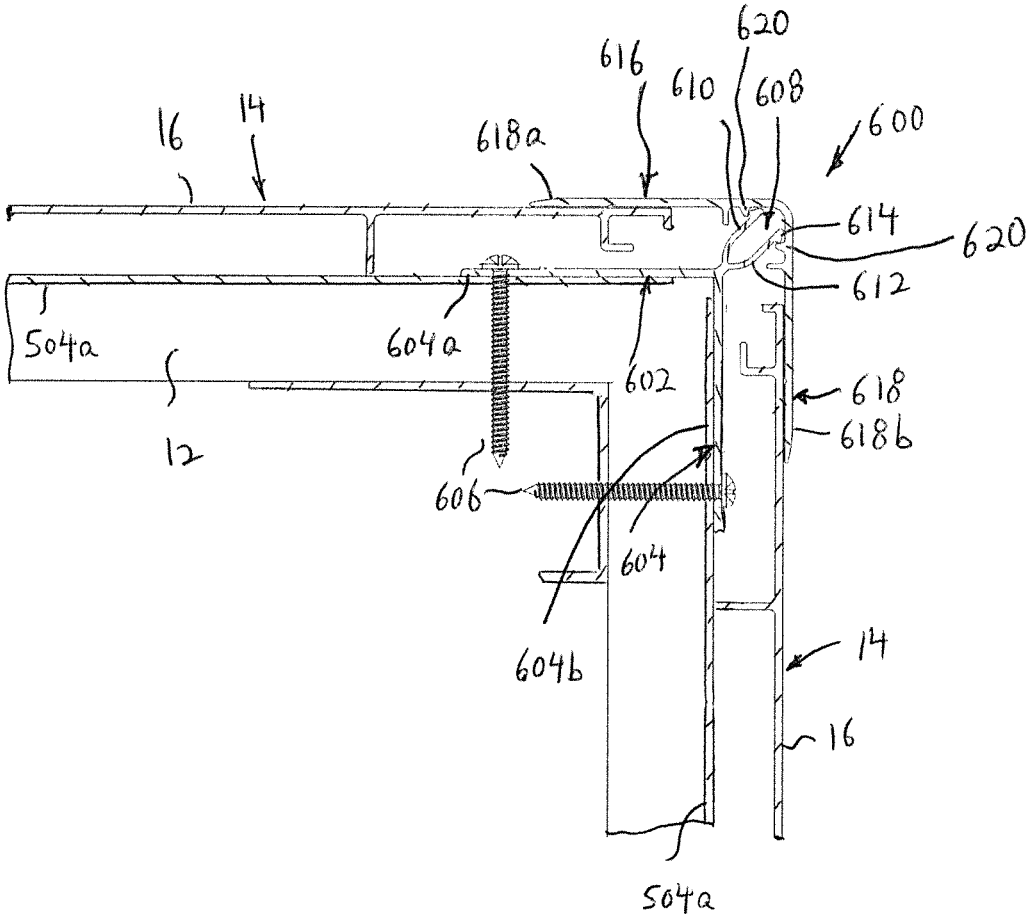
FIG. 8 is a cross-sectional view of an outer corner connecting arrangement for connecting together wall panels at an outer corner.

When wall panels 14 meet at a corner, they must be connected together as well. In this regard, as shown in FIG. 8, when wall panels 14 are positioned on the outside of an existing wall 12, an outer corner connecting member 600 is provided.

Specifically, outer corner connecting member 600 includes a corner connecting base 602 having an L-shaped base wall 604 secured to the outside corner of existing wall 12. L-shaped base wall 604 includes a first planar wall 604*a* and a second planar wall 604*b* connected to first planar wall 604*a* at a right angle, with both planar walls 604*a* and 604*b* connected to existing wall 12 by screws 606. Corner connecting base 602 includes an elongated fork wall 608 extending outwardly from the juncture of first and second planar walls 604*a* and 604*b*. Elongated fork wall 608 includes two parallel, spaced apart connecting walls 610 and 612, each including an outwardly extending barb 614 at the upper end thereof.

Outer corner connecting member 600 further includes a cover 616 formed by an elongated L-shaped outer cover wall 618 having a first planar wall 618*a* in overlying, spaced apart relation to first planar wall 604*a*, and a second planar wall 618*b* connected to first planar wall 618*a* at a right angle, and in overlying, spaced apart relation to second planar wall 604*b*. Cover 616 includes inwardly extending barbs 620 which engage barbs 614 to secure cover 616 on corner connecting base 602.

With this arrangement, corner connecting base 602 is secured to existing wall 12 by screws 606. The ends of adjacent wall panels 14 meet at the corner, and cover 616 is snapped onto corner connecting base 602 to engage and cover the ends of adjacent wall panels beneath first and second planar walls 618*a* and 618*b*. Thus, outer corner connecting member 600 covers the gap between the side edges of wall panels 14 that meet at the corner, while also helping to secure wall panels 14 in position on existing wall 12.

Figure 9:
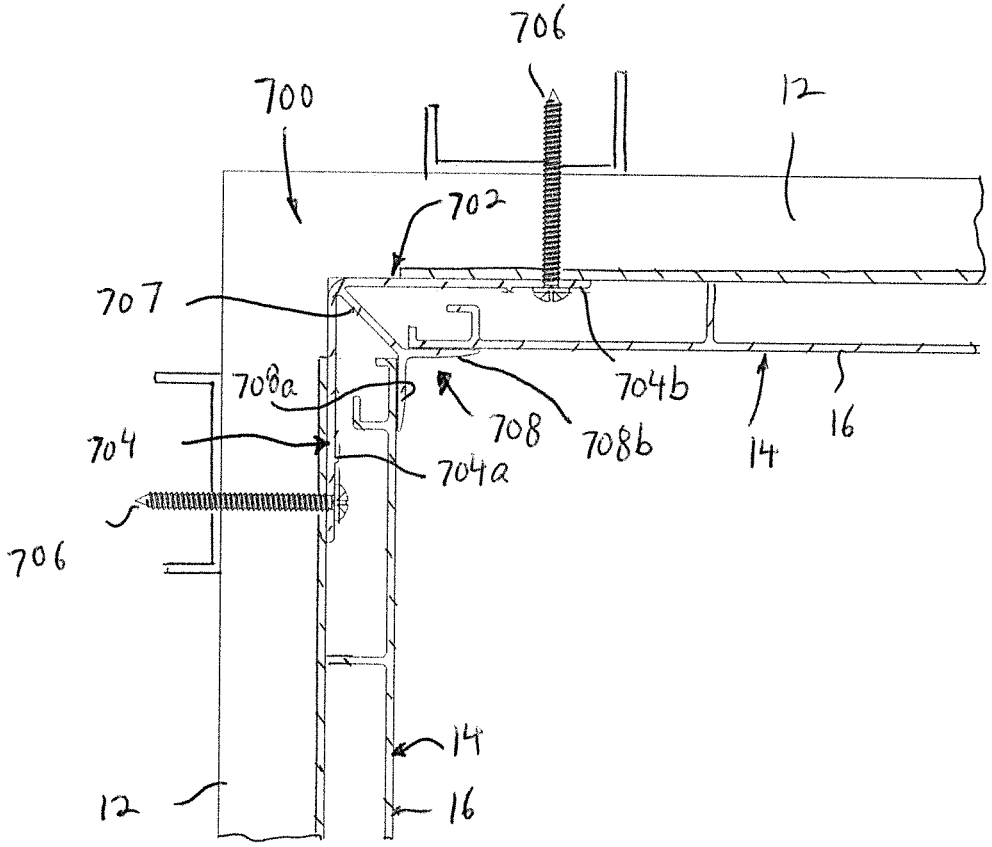
FIG. 9 is a cross-sectional view of an inner corner connecting arrangement for connecting together wall panels at an inner corner.

As shown in FIG. 9, when wall panels 14 are positioned on the inside of an existing wall 12, an inner corner connecting member 700 is provided.

Specifically, inner corner connecting member 700 includes a corner connecting base 702 having an L-shaped base wall 704 secured to the inside corner of existing wall 12. L-shaped base wall 704 includes a first planar wall 704*a* and a second planar wall 704*b* connected to first planar wall 704*a* at a right angle, with both planar walls 704*a* and 704*b* connected to existing wall 12 by screws 706. Corner connecting base 702 includes an inner diagonal wall 707 extending inwardly from the juncture of first and second planar walls 704*a* and 704*b*, with an elongated fork wall 708 connected to the free end of inner diagonal wall 707 and extending inwardly therefrom. Elongated fork wall 708 includes a first planar wall 708*a*, and a second planar wall 708*b* connected to first planar wall 708*a* at a right angle, and in overlying, spaced relation to first and second planar walls 704*a* and 704*b*, respectively.

With this arrangement, inner corner connecting base 702 is secured to existing wall 12 by screws 706. The ends of adjacent wall panels 14 which meet at the corner extend beneath first and second planar walls 708*a* and 708*b*. Thus, inner corner connecting member 700 covers the gap between the side edges of wall panels 14 that meet at the corner, while also helping to secure wall panels 14 in position on existing wall 12.

Figure 10:
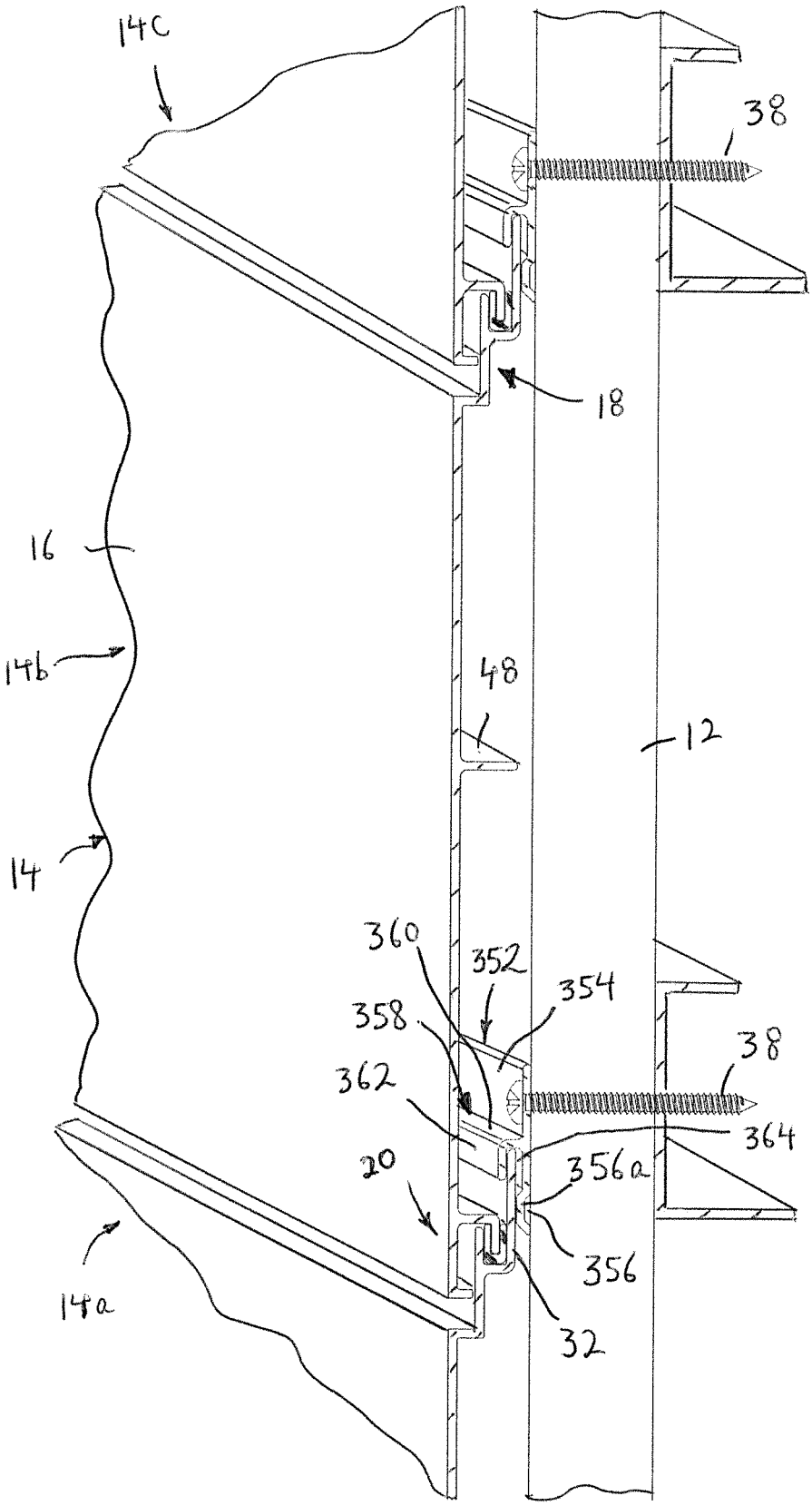
FIG. 10 is a perspective view of an interlocking wall panel arrangement according to a second embodiment of the present invention for easily mounting wall panels over an existing wall.
Figure 11:
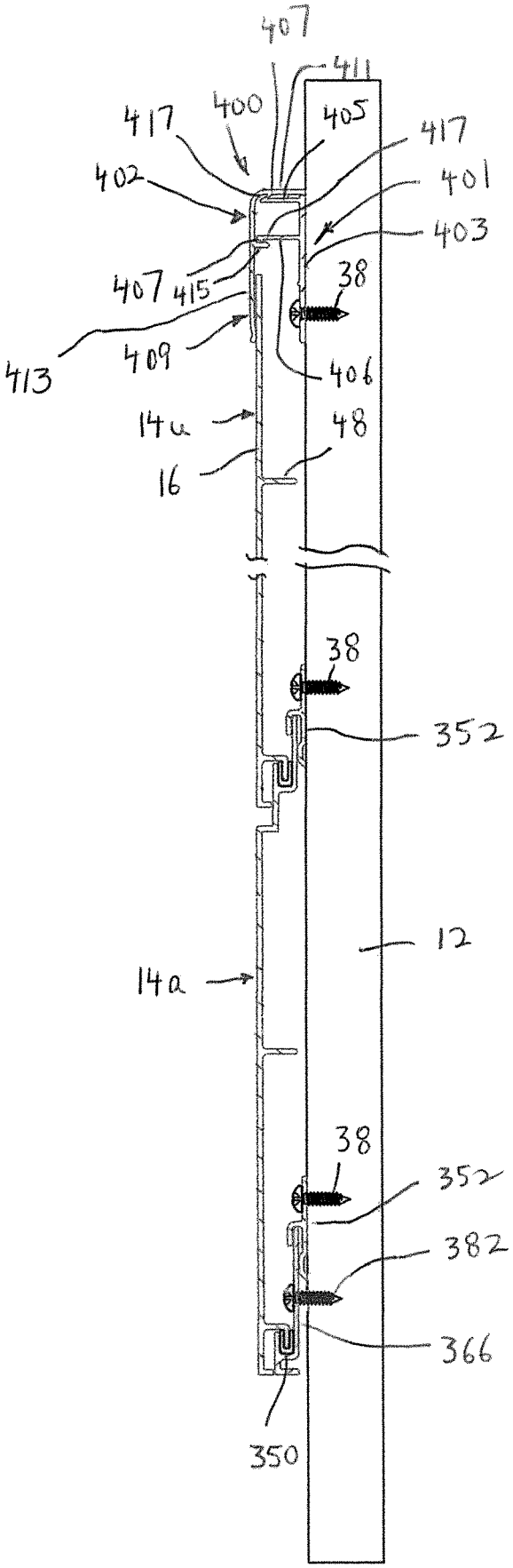
FIG. 11 is a cross-sectional view showing securement of the lowermost end and uppermost end of the interlocking wall panel arrangement according to the second embodiment.

FIGS. 10 and 11 show a wall panel arrangement 310 which is identical with wall panel arrangement 10 of FIG. 1, except as discussed below. Elements common to both wall panel arrangements 10 and 310 are described by the same numerals.

Wall panel arrangement 310 differs from wall panel arrangement 10 by eliminating lip 34 and tail section 36. Because tail section 36 is eliminated, wall panel arrangement 310 includes clips 352 for engaging with and securing fourth walls 32 to existing wall 12.

As shown, each clip 352 includes a base wall 354 that seats flush against existing wall 12, and which is secured thereto by spaced apart screws 38 extending therethrough. Base wall 354 further includes a bent trapezoidal shaped section 356 at the end thereof which is opposite to the portion at which screws 38 are inserted. In this manner, the rear surface of fourth wall 32 seats upon the smaller side 356*a* of trapezoidal shaped section 356.

Clip 352 further includes an L-shaped securement wall 358 extending outwardly therefrom. Specifically, L-shaped securement wall 358 includes a first wall 360 extending outwardly in a transverse manner from the exposed surface of base wall 354 at a position which substantially bisects base wall 354, and a second wall 362 which extends at an angle, preferably a right angle, from the free end of first wall 360 in a direction toward trapezoidal shaped section 356, and in parallel, spaced relation to base wall 354, so as to define a U-shaped channel 364 between base wall 354, first wall 360 and second wall 362.

With this arrangement, fourth wall 32 of a wall panel 14 is captured within U-shaped channel 364.

Figure 12:
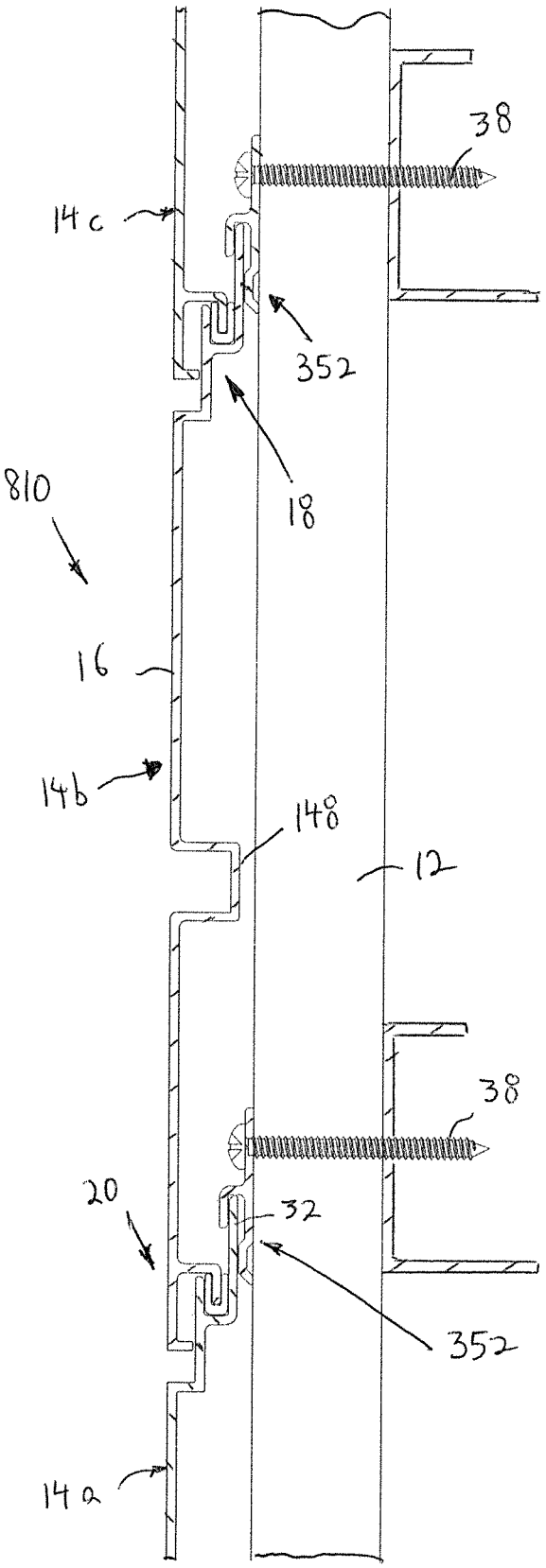
FIG. 12 is a cross-sectional view of an interlocking wall panel arrangement according to a modification of the second embodiment.

FIG. 12 shows a wall panel arrangement 810 which is identical with wall panel arrangement 110 of FIG. 2, except as discussed below. Elements common to both wall panel arrangements 210 and 810 are described by the same numerals.

Wall panel arrangement 810 differs from wall panel arrangement 110 by eliminating lip 34 and tail section 36. Because tail section 36 is eliminated, wall panel arrangement 810 includes clips 352, which are the same as clips 352 in FIGS. 10 and 11, for engaging with and securing fourth walls 32 to existing wall 12.

It will be appreciated that, with wall panel arrangements 310 and 810, intermediary support walls 48 and 148 are spaced from existing wall 12. However, intermediary support walls 48 and 148 can be extended to contact existing wall 12 in the manner shown in FIGS. 1 and 2.

Figure 13:
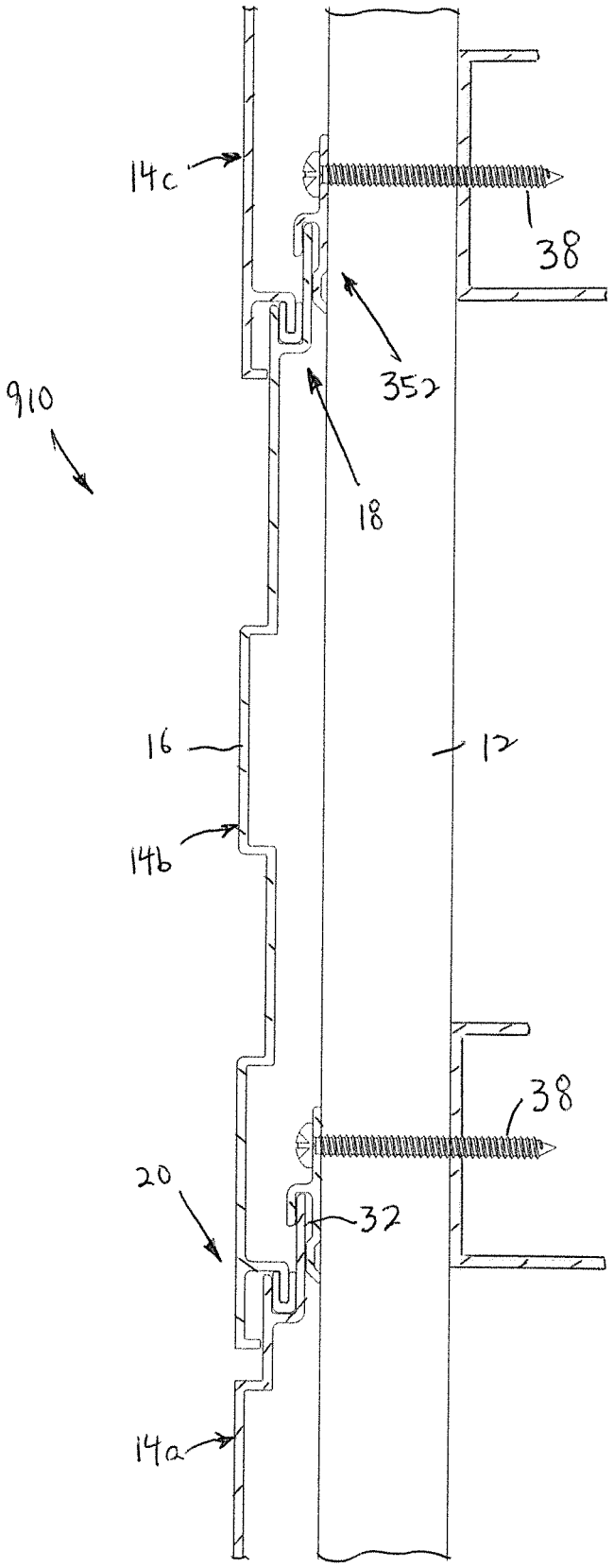
FIG. 13 is a cross-sectional view of an interlocking wall panel arrangement according to another modification of the second embodiment.

FIG. 13 shows a wall panel arrangement 910 which is identical with wall panel arrangement 210 of FIG. 3, except as discussed below. Elements common to both wall panel arrangements 210 and 910 are described by the same numerals.

Wall panel arrangement 910 differs from wall panel arrangement 210 by eliminating lip 34 and tail section 36.

Because tail section 36 is eliminated, wall panel arrangement 910 includes clips 352, which are the same as clips 352 in FIGS. 10 and 11, for engaging with and securing fourth walls 32 to existing wall 12.

As discussed above with respect to FIG. 3, main wall panel section 216 is not planar, but rather, has a three-dimensional shape of a square wave shape in cross-section, although any three-dimensional shape can be used for the main wall panel section, for example, three-dimensional shapes of the type shown in applicant's U.S. Pat. No. 9,631,372. In like manner, the portion of main wall panel section 16, 116, 216 between third L-shaped wall 40 and lip 46 of any of the embodiments can separately and independently have any three-dimensional shape, for example, as shown in dashed lines in FIG. 3.

Further, as shown in FIG. 1, there is a gap between first end 16*a* of wall panel 14*a* and second end of wall panel 14*b*. The dimensions of this gap can be adjusted by varying different factors such as the length of main wall panel section 16, 116, 216 between third L-shaped wall 40 and lip 46, the positioning of fifth wall 42 on main wall panel section 16, 116, 216, the length of sixth wall 44, etc.

in addition, although the wall panels have been described as being assembled from a lowermost wall panel 14*a* to an uppermost wall panel 14*u* in a vertical direction, the present invention is not limited thereby. For example, the wall panels 14 can be assembled in interlocking relation in a left to right, or right to left, direction, that is, 90° from the arrangements shown in the drawings.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. An interlocking wall panel arrangement for mounting wall panels to an existing wall, comprising: a plurality of wall panels, each of the wall panels including: a main wall panel section, a first interlocking section at a first end of the main wall panel section, and a second interlocking section at a second end opposite the first end of the main wall panel section; the first interlocking section having a first L-shaped wall connected to the first end of the main wall panel and a second L-shaped wall connected to the first L-shaped wall; wherein the first L-shaped wall includes a first wall extending rearwardly at an angle from the first end of the main wall panel section and a second wall extending at an angle from a free end of the first wall in a direction away from the main wall panel section and in a parallel and offset relation from the main wall panel section; and wherein the second L-shaped wall includes a third wall extending rearwardly at an angle from the second wall in a direction away from the main wall panel section at a position spaced inwardly from a free end of the second wall and in a parallel and offset relation from to the first wall, and a fourth wall extending at an angle from a free end of the third wall in a direction away from the main wall panel section in a parallel and offset relation from both the second wall and the main wall panel section; the second interlocking section having a third L-shaped wall, said third L-shaped wall spaced slightly inwardly from the second end of the main wall panel section; wherein the third L-shaped wall including a fifth wall extending rearwardly at an angle from a rear surface of the main wall panel section, and a sixth wall extending at an angle from a free end of the fifth wall in a direction away from the first L-shaped wall, in a parallel offset relation from the main wall panel section; the second interlocking section of the main wall panel engaging with the first interlocking section of another of said wall panels; and a securing arrangement for securing the first interlocking section to the existing wall.

2. An interlocking wall panel arrangement according to claim 1, wherein the walls of the first interlocking section defining a channel, and the second interlocking section includes the sixth wall that fits within the channel of said another of the wall panels.

3. An interlocking wall panel arrangement according to claim 1, wherein the first and second interlocking sections extend rearwardly from said main wall panel section so as to space said main wall panel section from the existing wall when one of the wall panels is secured to the existing wall.

4. An interlocking wall panel arrangement according to claim 3, wherein each of the wall panels further includes an intermediary support wall extending rearwardly of the main wall panel section at a position between said first and second interlocking sections.

5. An interlocking wall panel arrangement according to claim 1, wherein said securing arrangement includes a tail wall formed integrally as a single piece with the first interlocking section.

6. An interlocking wall panel arrangement according to claim 5, wherein the walls of the first interlocking section defining a channel, the sixth wall of the second interlocking section fitting within the channel of said another of the wall panels, and the tail wall formed as an extension of the walls defining the channel.

7. An interlocking wall panel arrangement according to claim 1, wherein the main wall panel section has a three-dimensional shape in cross-section.

8. An interlocking wall panel arrangement according to claim 1, wherein the securing arrangement includes a clip for holding the first interlocking section and which is adopted to be secured to the existing wall by fastening members.

9. An interlocking wall panel arrangement according to claim 8, wherein the clip having walls defining a channel, and the first interlocking section having the fourth wall that fits within the channel of the clip.

10. An interlocking wall panel arrangement according to claim 1, further comprising a starter member for securing the second interlocking section of a first one of the wall panels to the existing wall.

11. An interlocking wall panel arrangement according to claim 10, wherein the starter member includes:

a base wall adapted to be secured to the existing wall by fastening members, and an L-shaped wall extending outwardly from a free end of the base wall so as to define a channel with the base wall for receiving and holding the second interlocking section therein.

12. An interlocking wall panel arrangement according to claim 1, further comprising a finishing member for securing the first interlocking section of a last one of the wall panels to the existing wall.

13. An interlocking wall panel arrangement according to claim 12, wherein the finishing member includes: a base wall adapted to be secured to the existing wall by fastening members, and an L-shaped wall extending outwardly from a free end of the base wall so as to define a channel with the base wall for receiving and holding the first interlocking section therein.

14. An interlocking wall panel arrangement according to claim 1, further comprising a side connecting arrangement for connecting together side edges of adjacent ones of the wall panels.

15. An interlocking wall panel arrangement according to claim 14, wherein the side connecting arrangement includes: a connecting base having an elongated base wall adapted to be secured to the existing wall along the side edges of the wall panels, a cover wall is positioned over the adjacent side edges of the adjacent wall panels and a securing arrangement for of the cover wall securing the cover wall to the connecting base in order to sandwich the side edges of the wall panels therebetween.

16. An interlocking wall panel arrangement according to claim 15, wherein the securing arrangement includes at least one first wall formed with the cover wall and extending between adjacent side edges of the adjacent side panels, and at least one second wall formed with the connecting base engaging with and holding the at least one first wall to secure the cover wall in overlying spaced relation with the connecting base.

17. An interlocking wall panel arrangement according to claim 1, further comprising a corner connecting arrangement for connecting together ends of adjacent ones of the wall panels at one of: an outside corner of the existing wall, or an inside corner of the existing wall.

18. An interlocking wall panel arrangement according to claim 1, wherein a spacing exists between adjacent ones of the wall panels, and the spacing is adjusted by varying a dimension of any one of the walls of: the first interlocking section, the second interlocking section or both the first interlocking section and the second interlocking section.

* * * * *